US007621261B2

(12) United States Patent
Lisseveld

(10) Patent No.: US 7,621,261 B2
(45) Date of Patent: Nov. 24, 2009

(54) FUEL TREATMENT DEVICE USING A MAGNETIC FIELD

(76) Inventor: Wout Lisseveld, 1661 Estero Blvd. #18, Ft. Myers Beach, FL (US) 33932

( * ) Notice: Subject to any disclaimer, the term of this patent is extended or adjusted under 35 U.S.C. 154(b) by 126 days.

(21) Appl. No.: 11/307,837

(22) Filed: Feb. 24, 2006

(65) Prior Publication Data

US 2006/0159562 A1 Jul. 20, 2006

Related U.S. Application Data

(63) Continuation of application No. 10/462,026, filed on Jun. 13, 2003, now Pat. No. 7,004,153.

(51) Int. Cl.
*F02M 72/04* (2006.01)

(52) U.S. Cl. ..... 123/538

(58) Field of Classification Search ..... 123/536–538; 210/222, 695

See application file for complete search history.

(56) References Cited

U.S. PATENT DOCUMENTS 3,349,354 A * 10/1967 Miyata ..... 335/209
3,586,015 A 6/1971 Kitzner
4,210,535 A 7/1980 Risk
4,334,889 A 6/1982 Takabayashi
4,407,719 A 10/1983 Van Gorp
4,414,951 A 11/1983 Saneto
4,422,933 A 12/1983 Sverre et al.
4,422,935 A 12/1983 Mattingly
4,430,785 A 2/1984 Sanderson
4,460,516 A 7/1984 Kapitanov et al.
4,461,262 A * 7/1984 Chow ..... 123/536
4,568,901 A 2/1986 Adam
4,572,145 A 2/1986 Mitchell et al.
4,662,314 A 5/1987 Moore, Jr.
4,716,024 A * 12/1987 Pera ..... 422/186.01
4,888,113 A 12/1989 Holcomb
4,946,590 A 8/1990 Hertzog
4,950,317 A 8/1990 Dottermans
5,005,189 A 4/1991 Hackett, Jr.
5,009,791 A 4/1991 Lin et al.
D319,287 S 8/1991 Baumstark et al.
5,076,246 A * 12/1991 Onyszczuk ..... 123/538

(Continued)

FOREIGN PATENT DOCUMENTS

WO 2004/031566 A1 4/2004

OTHER PUBLICATIONS

Algae-X International, Inc., Product Brochure, May 1, 2003.

(Continued)

*Primary Examiner*—M. McMahon
(74) *Attorney, Agent, or Firm*—Hahn Loeser & Parks LLP

(57) ABSTRACT

Magnetic fuel treatment devices are disclosed, the devices comprising, in part, a housing body, cover, and magnet, the combination of which forming an inner fuel channel through which fuel may flow for treatment therein. The fuel treatment device that uses a magnetic field to improve combustion and filterability of conventional petroleum-based hydrocarbon fuels utilizing an arcuate fuel path, in one embodiment having a "C" shaped radial cross-section positioned and dimensioned to optimize the treatment of fuel through a magnetic field.

20 Claims, 4 Drawing Sheets

U.S. PATENT DOCUMENTS

| | | | | | |
|---|---|---|---|---|---|
| 5,124,045 | A | | 6/1992 | Janczak et al. | |
| 5,127,385 | A | | 7/1992 | Dalupin | |
| 5,161,512 | A | | 11/1992 | Adam et al. | |
| 5,166,620 | A | | 11/1992 | Panosh | |
| 5,171,487 | A | | 12/1992 | Hudz | |
| 5,174,892 | A | | 12/1992 | Davis | |
| 5,178,757 | A | | 1/1993 | Corney | |
| 5,190,018 | A | | 3/1993 | Costello et al. | |
| 5,194,413 | A | | 3/1993 | Kumar | |
| 5,221,471 | A | | 6/1993 | Huntley | |
| 5,238,558 | A | | 8/1993 | Curtis | |
| 5,239,911 | A | | 8/1993 | Ostor | |
| 5,243,946 | A | | 9/1993 | Dalupan | |
| 5,248,437 | A | * | 9/1993 | Forrest | 210/695 |
| 5,249,552 | A | | 10/1993 | Brooks | |
| 5,254,247 | A | | 10/1993 | Kashani | |
| 5,271,369 | A | | 12/1993 | Melendrez | |
| 5,271,639 | A | | 12/1993 | Nishizawa | |
| 5,271,834 | A | | 12/1993 | Mondiny | |
| 5,288,401 | A | | 2/1994 | Rodriguez | |
| 5,296,141 | A | | 3/1994 | Ellison | |
| 5,304,299 | A | | 4/1994 | Kumar | |
| 5,331,807 | A | | 7/1994 | Hricak | |
| 5,348,050 | A | | 9/1994 | Ashton | |
| 5,359,979 | A | | 11/1994 | Anfinson et al. | |
| 5,364,536 | A | | 11/1994 | Mercier | |
| 5,366,623 | A | | 11/1994 | Clair | |
| 5,368,748 | A | | 11/1994 | Sanderson | |
| D353,438 | S | | 12/1994 | Yuksel | |
| 5,380,430 | A | | 1/1995 | Overton et al. | |
| 5,411,143 | A | | 5/1995 | Greene | |
| 5,454,998 | A | | 10/1995 | Bogatin et al. | |
| 5,460,144 | A | * | 10/1995 | Park et al. | 123/538 |
| 5,487,370 | A | * | 1/1996 | Miyazaki | 123/538 |
| 5,603,368 | A | | 2/1997 | Colson et al. | |
| 5,637,226 | A | | 6/1997 | Adam et al. | |
| 5,716,520 | A | | 2/1998 | Mason | |
| RE35,826 | E | | 6/1998 | Spiegel | |
| 5,918,636 | A | | 7/1999 | Mitchell et al. | |
| 6,000,382 | A | | 12/1999 | Albisetti | |
| D420,092 | S | | 2/2000 | Lisseveld | |
| 6,041,763 | A | | 3/2000 | Akyildiz | |
| 6,143,045 | A | | 11/2000 | Witaszak et al. | |
| 6,361,689 | B1 | | 3/2002 | Munzing | |
| 7,004,153 | B2 | | 2/2006 | Lisseveld | |
| 2006/0048758 | A1 | * | 3/2006 | Turi | 123/538 |

OTHER PUBLICATIONS

Algae-X International, Inc., Technical drawings of LG-X200, sold in 2002 (3 pages).

Algae-X International, Inc., Bar Chart—"Fuel Line Area vs Fuel Channel Area" for products sold prior to Jun. 13, 2002.

Algae-X International, Inc., LG-X Product Specification for Devices, Nov. 26, 2002.

* cited by examiner

FUEL TREATMENT DEVICE USING A MAGNETIC FIELD

This application is a continuation application of U.S. non-provisional patent application Ser. No. 10/462,026, filed Jan. 13, 2003, and hereby incorporated by reference.

TECHNICAL FIELD

The present invention relates to magnetic fuel treatment devices and methods, and in particular, to a fuel treatment device that uses a magnetic field to improve combustion and filterability of conventional petroleum-based hydrocarbon fuels utilizing an arcuate fuel path having a "C" shaped radial cross-section positioned and dimensioned to optimize the treatment of fuel through a magnetic field.

BACKGROUND OF THE INVENTION

Refining methods employed in the late 20th and early 21st centuries produce hydrocarbon fuels and oils that are unstable. Such instability results in polymerization and agglomerations of organic compounds that reduce filterability and clean combustion of diesel fuels and gas-oil. In the case of hydrocarbon fuels, asphaltenes (precursors to heavy hydrocarbon oils) and resins have mechanical affinity for each other and thereby have a tendency to form flocculations or aggregations. As these clusters of large molecules increase in size, they clog fuel filters and can eventually contribute to sludge in fuel storage tanks.

Fuel treatment methods have worked from the premise that filterability problems with diesel fuel were largely due to "bio-fouling" (i.e. microbial activity from fungus, yeast, mold, and aerobic or anaerobic sulfur-reducing bacteria). Although microbial activity plays a role in the deterioration of fuel quality and may contribute to repolymerization, it is not the sole cause of fuel instability.

Prior art magnetic fuel treatment devices have focused on passing fuel through a weak magnetic field (with flux density of 200 to 500 gauss) for the purpose of improving fuel filtration and alleviating the filter clogging believed to be caused by microbial contaminant build-up. Even though results have shown some improvement in fuel filterability, current methods have not been able to address the larger issues of fuel stability.

Magnetic field flux density varies depending on the magnetic material used, the shape of the magnet, the positioning of the poles, and proximity to the poles. At the atomic level, inductive forces are transmitted to a fluid passing through magnetic flux, producing an orientation effect on polar molecules in the fuel, and thus discourages clustering of paraffins and other long chain molecules, allowing them, as a consequence, to stay in suspension and thus burn more completely. The strength of this effect depends on the direction of fluid flow relative to flux lines, as well as velocity of flow and magnetic flux density.

SUMMARY OF THE INVENTION

Research and field trials conducted by the inventor have shown that fuel channel design can be altered to optimize the orientation effect beyond that of current treatment devices, thereby producing unexpected improvements in fuel combustion and filterability. At least one improvement over the prior art is provided by a fuel treatment device comprising: a housing, said housing further a fuel entry port, and a fuel exit port and a generally arcuate fuel channel between the fuel entry port and the fuel exit port; an annular magnet positioned within said housing and forming at least a portion of the arcuate fuel channel, the annular magnet having a central axis; wherein the arcuate fuel channel has a "C" shaped radial cross-section with respect to the central axis of the magnet.

At least one improvement over the prior art is provided by a fuel treatment device comprising: a housing, said housing further comprising a housing body, a housing cover, a fuel entry port, a fuel exit port and a generally arcuate fuel channel between the fuel entry port and the fuel exit port; an annular magnet having a first planar surface opposite a second planar surface and an outer cylindrical surface and an inner cylindrical surface, wherein the magnet is positioned within the housing and forming at least a portion of the arcuate fuel channel, the annular magnet having a central axis; and wherein the maximum radial distance or axial distance between the magnet and the housing forming the fuel channel is 30% of the thickness of the magnet.

At least one improvement over the prior art is also provided by a method for magnetically treating fuel comprising the steps of: providing fuel treatment device comprising: a housing, said housing further comprising a housing body, a housing cover, a fuel entry port, a fuel exit port and a generally arcuate fuel channel between the fuel entry port and the fuel exit port; an annular magnet having a first planar surface opposite a second planar surface and an outer cylindrical surface and an inner cylindrical surface, wherein the magnet is positioned within the housing and forming at least a portion of the arcuate fuel channel, the annular magnet having a central axis; and wherein the arcuate fuel channel has a "C" shaped radial cross-section with respect to the central axis of the magnet; attaching a fuel line to the fuel entry port and the fuel exit port of the fuel treatment device; forcing fuel in the fuel treatment device such that the fuel enters the fuel entry port and enters the arcuate fuel channel; subjecting the fuel to a magnetic field created by the magnet while the fuel is in the fuel channel; and allowing the treated fuel to exit the fuel treatment device through the fuel exit port.

DETAILED DESCRIPTION OF THE DRAWINGS

Figure 1:
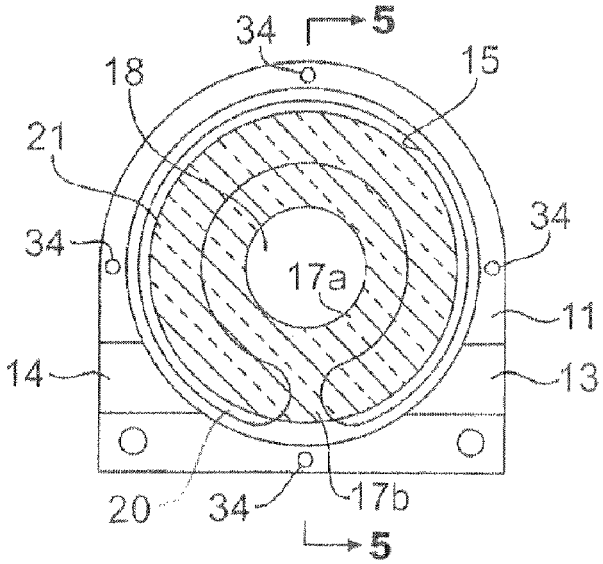
FIG. 1 is a top view of the housing of the device (without cover) showing the magnet contained therein.
Figure 2:
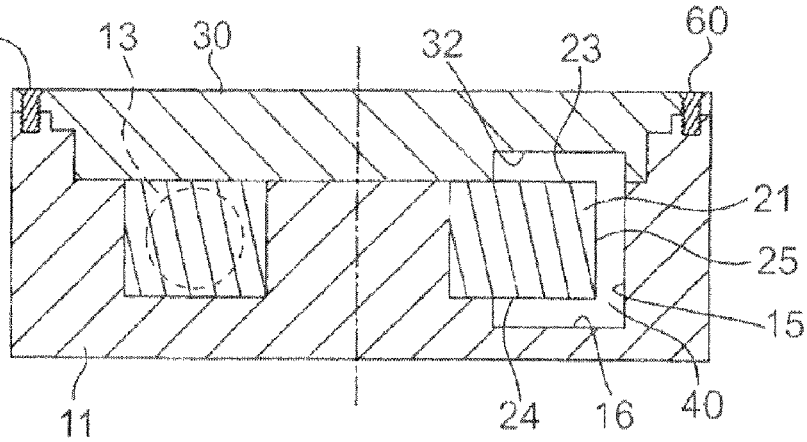
FIG. 2 is a side cross-sectional view of the housing illustrated in FIG. 10, with the fuel entry port shown in phantom.

Referring now to the figures, the invention in certain aspects comprises a fuel treatment device 10 comprising a housing having a housing body 11, and a housing cover 30, and a generally arcuate fuel channel 40 between a fuel entry port 13 and the fuel exit port 14. The fuel entry port 13 and the fuel exit port 14, in the embodiments illustrated in the figures, are in registration with one another. When the device is installed within a fuel line, the fuel line is split so that it may be connected to the fuel entry and exit ports 13, 14. FIG. 1 illustrates the fuel entry port 13, for example, as being positioned on the right side of the housing; however, it will be appreciated by the skilled artisan that these fuel ports may be reversed (i.e. the entry port may be where the exit port 14 is shown). FIG. 2 shows the entry port 13, which has circular configuration. The cross-sectional area of the port is defined by $\pi r^2$, wherein "r" is the radius of the two-dimensional circle of the port formed in cross section (see FIG. 4, for example).

The housing comprises an inner compartment 12 within the device housing has a substantially circular side wall 15 when viewed from the top (FIG. 1). The inner compartment further includes a lower floor 16, and in a preferred embodiment, a central platform 17 integral therewith. In the embodiments shown herein, the platform has a circular portion 17*a* and an arm portion 17*b* integral with and extending therefrom. The arm portion 17*b* is also integral with a portion of the side wall 15 of the inner compartment and positioned between the fuel entry and exit ports 13, 14, as shown in FIGS. 1-4, for example. Extending from the central platform is a post 18 having a diameter $D_1$ smaller than the diameter $D_2$ of the platform. As shown in the figures, the combination of the platform 17, side wall 15, and lower floor 16 form a substantially C-shaped groove 20 as best illustrated in FIG. 1.

Figure 10:
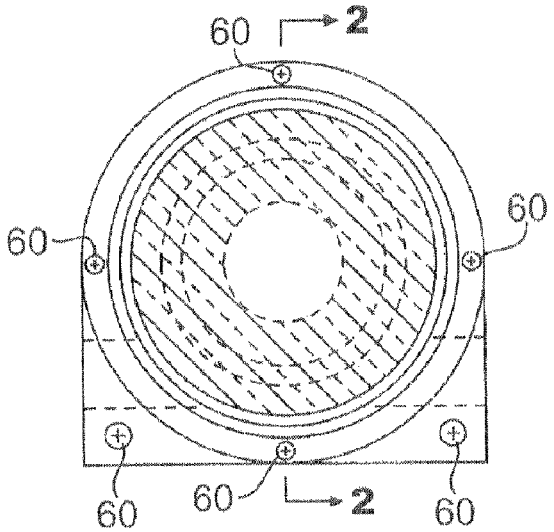
FIG. 10 is a top view of the device with the cover secured thereto, with the magnet and a portion of the inner compartment shown in phantom.
Figure 11:
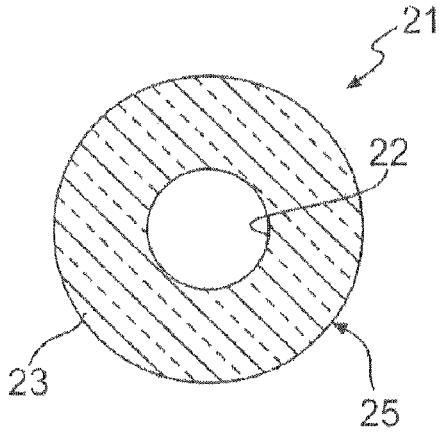
FIG. 11 is a top view of the magnet.

The device includes an annular magnet 21 (e.g. a ceramic 8 type magnet) housed within the inner compartment (in FIGS. 1 and 10, the magnet is shown in phantom). The magnet has a central opening 22, or inner cylindrical surface, sufficiently sized to accommodate the central post 18 of the housing. The magnet includes upper 23 and lower 24 surfaces, or first and second planar surfaces, as well as an outer surface 25, or outer cylindrical surface, defining the circumference of the magnet when viewed from above (see FIG. 11). When the magnet is placed within the inner compartment of the housing, with the post 18 engaged within the central opening 22, the lower surface of the magnet is positioned upon the platform 17 to completely cover the platform, thereby obstructing fuel flow directly between the entry and exit ports.

Figure 3:
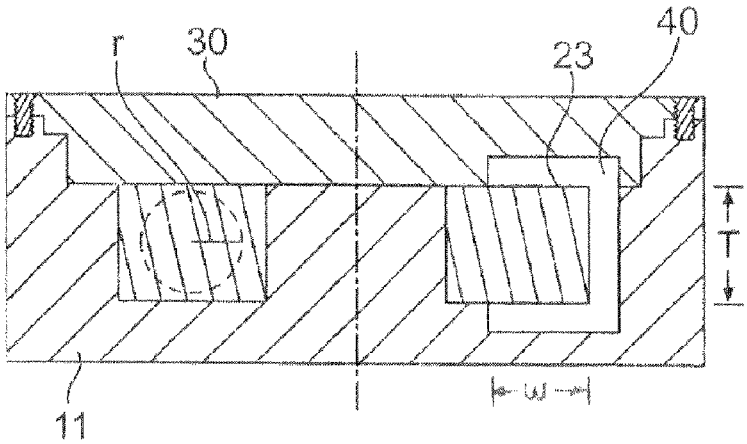
FIG. 3 is side cross-sectional view identical to that shown in FIG. 2, but referencing additional features of the device.
Figure 4:
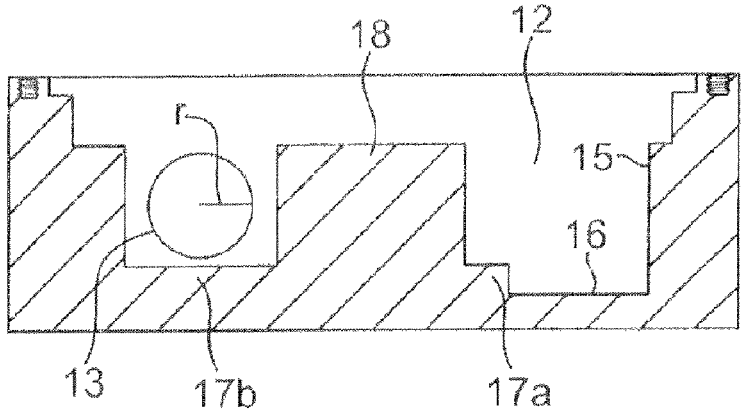
FIG. 4 is a side cross-sectional view of the housing illustrated in FIG. 1, but without the magnet.
Figure 5:
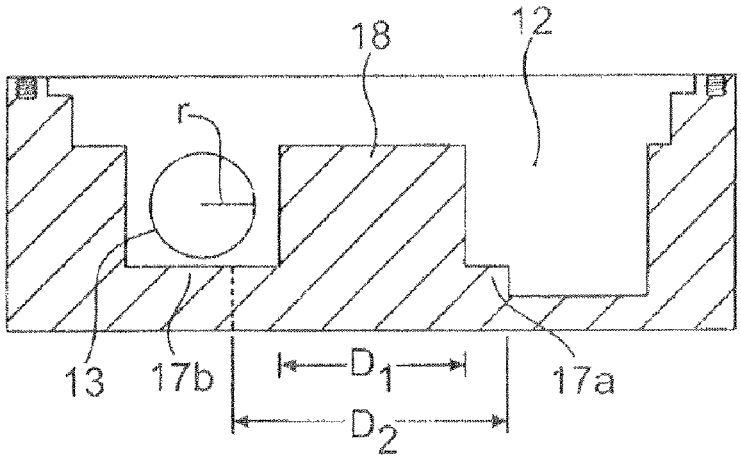
FIG. 5 is a side cross-sectional view identical to that shown in FIG. 4, but referencing additional features of the device.
Figure 6:
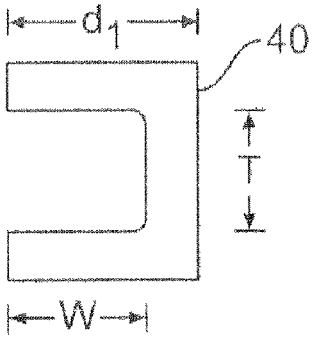
FIG. 6 is a cross-sectional view of the fuel channel illustrated in FIG. 2 provided for referencing features of the device.
Figure 7:
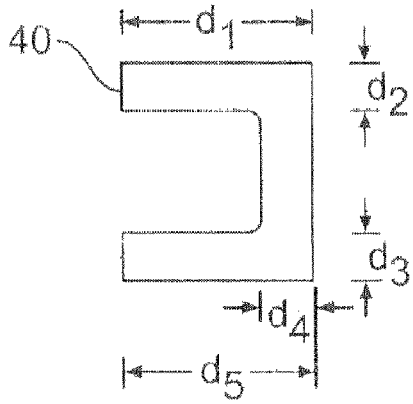
FIG. 7 is a cross-sectional view identical to that shown in FIG. 6, but referencing additional features of the device.
Figure 8:
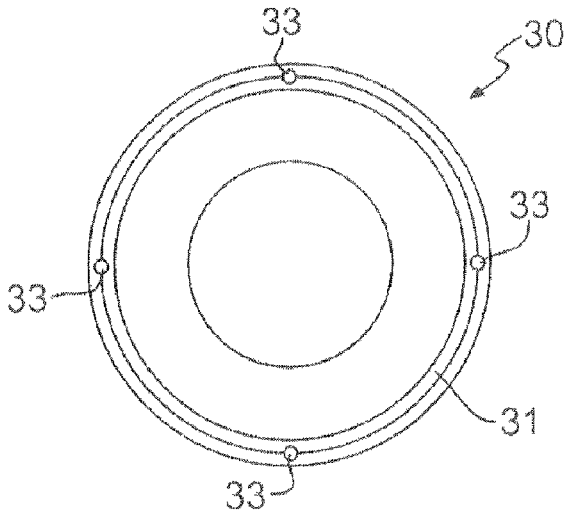
FIG. 8 is a top view of the cover.
Figure 9:
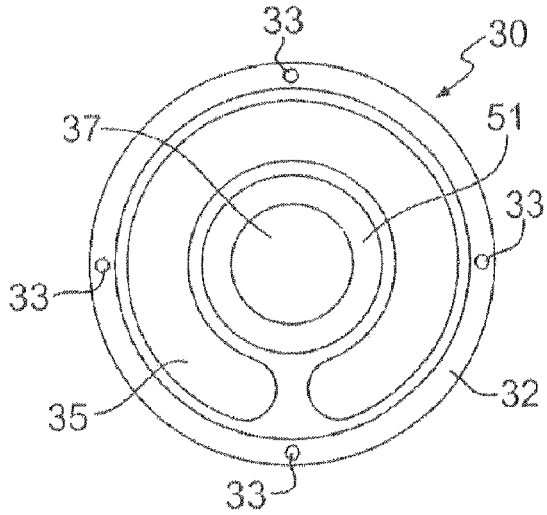
FIG. 9 is a bottom view of the cover illustrated in FIG. 8, showing the inner surface of the cover.

The housing includes a housing cover 30 having a top surface 31 (FIG. 8) and an inner surface 32 (FIG. 9). The cover may be removably secured to the housing body by any conventional fastening means, including, but not limited to, screws, bolts, pins, and the like. If screws 60, for example, are used to fasten the cover to the housing, a series of bores 33 are provided on the cover and a complementary series of threaded bores 34 are provided through the upper surface of the housing (FIG. 1), in registration with the cover bores 33, to engage the screws. As most clearly illustrated in FIG. 9, the inner surface 32 of the cover has a substantially C-shaped groove 35 corresponding to the C-shaped groove 20 of inner compartment of the housing, such that the grooves 20, 35, in combination with the surfaces of the magnet, form a fuel channel 40, as shown in FIGS. 2-4. The fuel channel 40 (shown in FIGS. 6-7) has a radial cross-sectional area in the shape of a "C".

O-rings may be used to form a seal between the cover and housing in order to prevent fuel leakage from the housing. In FIG. 9, elastomeric O-rings (not shown) may be placed in circular grooved areas 50, 51.

In previous devices known in the art, the cross-sectional area of the fuel treatment channel had been in the order of 3.5 times larger than the cross-sectional area of the engine's fuel line or fuel entry port of the treatment device. That is, the ratio of the fuel channel cross-sectional area to fuel line entry port cross-sectional area is around 3.5:1 in some current magnetic fuel treatment devices. In one aspect of the present invention, the fuel channel cross-sectional area is reduced, thereby resulting in an improvement in the treatment of the fuel. A preferred ratio of the fuel channel to port cross-sectional area is from about 0.65:1 to 2.5:1.

It has further been discovered by the inventor that inducing turbulence in the fluid flow further enhances the combustibility of magnetically treated fuel. Prior devices in the art have aimed to maintain laminar flow of fluid through the device; however, in the present invention, a narrower fuel channel (i.e. a channel width: exposed magnet width w ratio of less than 2.5:1, more preferably about 1.4:1 or less) is used and the fuel channel is redirected about an arc.

Similarly, in previous devices, the maximum distance between the outer surface of the magnet and the sides of the fuel treatment channel is from 75% to 300% of the magnet's thickness T. In one aspect of the present invention, the range for the maximum distance between the magnet's outer surface and the wall of the fuel channel (designated $d_2$, $d_3$, and $d_4$ in FIGS. 6-7 for ease of illustration) is from about 17% to about 30% of the magnet's thickness T. In particular, when this feature is combined with the reduced fuel channel area: fuel entry port area, such that a fuel within the device is concentrated or focused within the area of greatest magnetic flux density (i.e. about 600 to about 1,200 Gauss), with the unexpected result that the asphaltenes and waxes within the fuel (i.e. organic hydrocarbon compounds in crude oil and refined diesel and fuel-oil) are thereby affected to prevent their aggregation downstream. The inventor has discovered that such compounds are indeed only affected or influenced by magnetic fields stronger than the 200-500 Gauss range found in current magnetic fuel treatment devices. Consequently, the design of the inventive fuel treatment device provides a stronger magnetic field for fuel treatment, thereby improving combustibility of the treated fuel.

Aspects of the present invention may further include a fuel treatment device having a central platform, post, and magnet disposed upon the platform and post as described above; however, the magnet and platform are dimensioned such that about 50% to about 75%, preferably about 68%, of the lower surface of the magnet is covered by the platform. Similarly, the inner surface of the cover, which comprises a C-shaped groove described above that is defined in part by a centrally positioned raised platform 34, is sufficiently sized with respect to the magnet such that about 50% to 75%, preferably about 68%, of the magnet's upper surface is covered by the cover platform 34, thereby concentrating fuel flow within the device to areas of greatest flux density. Prior embodiments shield only about 19% of the magnet's outer surfaces. In combination, from about 50% to about 70%, more preferably about 58%, of the magnet's entire upper, lower, and outer surfaces are exposed to fuel flowing through the device (compared to up to about 87% average total exposure), thereby concentrating the fuel flow within the device to areas of greatest flux density for the benefits described herein.

Figure 12:
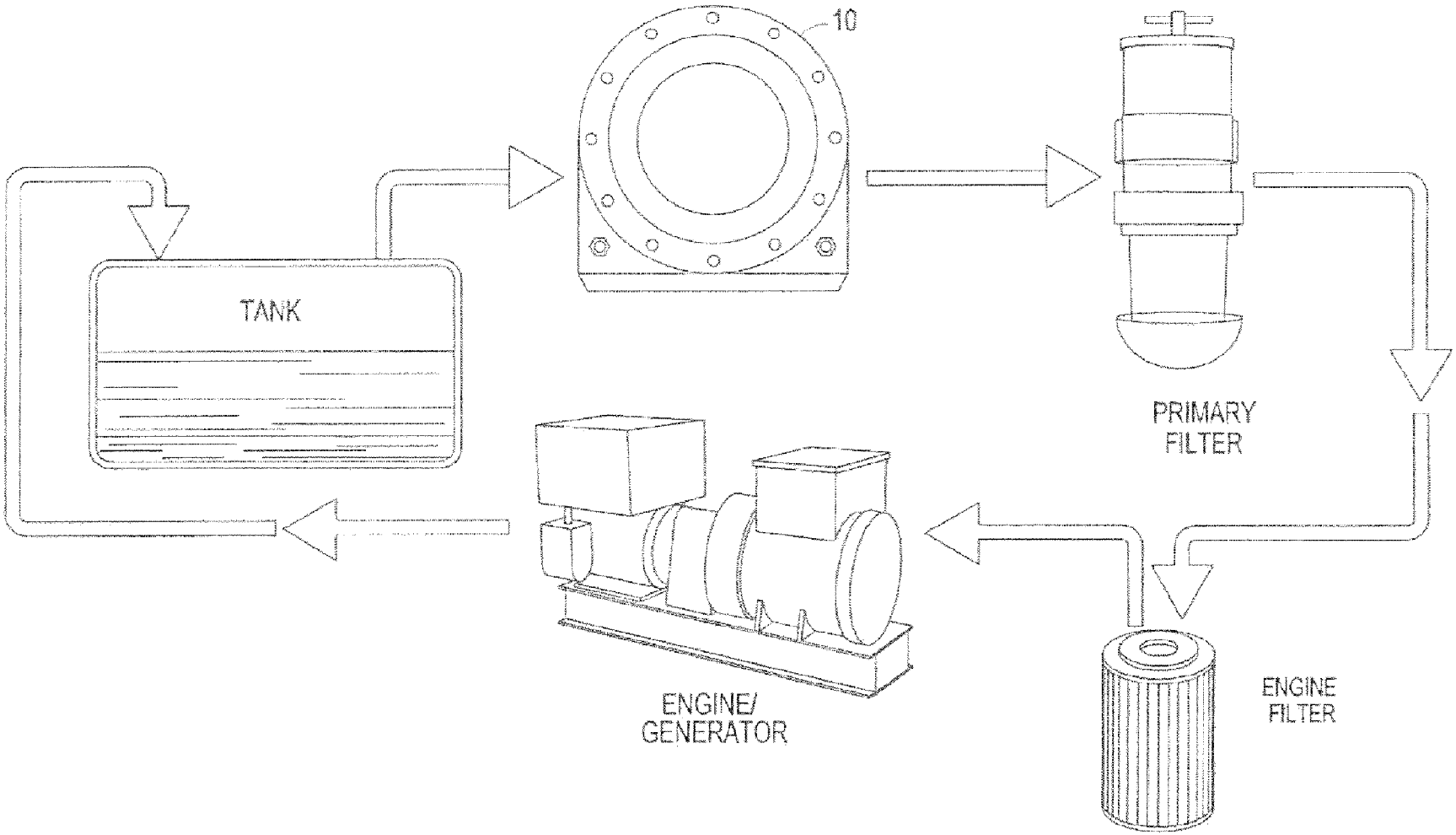
FIG. 12 is a flow chart of an exemplary engine system employing the inventive fuel treatment device.

The present invention may be used to treat fuel for use in a variety of applications. The invention may be installed in a motorized vehicle or other system powered by a fuel-operated engine generator. Preferably, the inventive fuel treatment device is installed between the fuel tank and primary filter assembly (FIG. 12). Fuel flows through the fuel entry port, through the fuel channel, and exits the exit port. While in the channel, the fuel is subjected to the magnetic field at a given velocity (e.g. 1-15 ft/sec, preferably 1-6 ft./sec) and dwell time (e.g. 0.1 to 1 second), depending upon the size of the fuel treatment device.

It will be appreciated by those of ordinary skill in the art that the dimensions of the inventive treatment device may be varied, with larger housings, for example, being employed for larger fuel engine systems, although various preferred ratios and percentages described herein remain the same. In a preferred commercial embodiment, the dimensions of the fuel channel, in the cross-section shown in FIGS. 6-7, 0.500 in ($d_1$)×0.265 in ($d_2$)×0.250 in. ($d_3$)×0.245 in. ($d_4$)×0.500 in. ($d_5$). A preferred size of magnet is 3.38 in (total diameter)× 1.280 in (ring width)×0.85 in (ring thickness or height), with a total surface area of 24.3 square inches.

The foregoing disclosure and description of the invention are illustrative and explanatory thereof, and various changes with respect to the size, shape, and materials, as well as in the details of the illustrated construction may be made without departing from the spirit of the invention, and therefore fall within the scope of the appended claims even though such variations were not specifically discussed above.

What is claimed is:

1. A fuel treatment device comprising:

a housing, said housing further comprising a housing body, a housing cover, a fuel entry port, a fuel exit port and a generally arcuate fuel channel between the fuel entry port and the fuel exit port;

an annular magnet positioned within the housing, the magnet forming at least a portion of the arcuate fuel channel, the annular magnet having a central axis; and wherein the arcuate fuel channel has a single "C" shaped radial cross-section with respect to a central axis of the magnet, the channel having a radially inward circumferential portion and a radially outward circumferential portion, where the cross-section lies in a plane perpendicular to the central axis, and where surfaces of the magnet form the entire radially inward circumferential portion of the "C" shaped arcuate fuel channel.

2. The fuel treatment device of claim 1, wherein the ratio of the radial cross-sectional area of the fuel channel to the cross-sectional area of the inlet port is 2.5:1 or less.

3. The fuel treatment device of claim 1, wherein the maximum radial distance or axial distance between the magnet and the housing forming the fuel channel is 30% of the thickness of the magnet.

4. The fuel treatment device of claim 1, wherein less than 70% of the magnet surfaces form at least a portion of the fuel channel.

5. The fuel treatment device of claim 1, wherein the annular magnet comprises a first planar surface opposite a second planar surface and an outer cylindrical surface and an inner cylindrical surface, and the fuel channel is formed by at least a portion of the outer cylindrical surface of the magnet.

6. The fuel treatment device of claim 1, wherein the fuel channel is at least partially formed by a circumferential surface of the magnet, the fuel channel extending about the circumference of the magnet.

7. The fuel treatment device of claim 1, wherein the magnet has a magnetic flux rating of at least 600 Gauss.

8. The fuel treatment device of claim 1, wherein the ratio of the maximum radial width of the fuel channel to the radial width of the exposed magnet surface is about 1.4:1 or less.

9. The fuel treatment device of claim 1, wherein the fuel entry port is separated from the fuel exit port by a baffle for directing the fuel into the arcuate fuel channel.

10. A fuel treatment device comprising:

a housing, said housing further comprising a housing body, a housing cover, a fuel entry port, a fuel exit port and a generally arcuate fuel channel between the fuel entry port and the fuel exit port;

an annular magnet positioned within the housing, the magnet obstructing fuel flow directly between the entry and the exit ports, the magnet forming the entire surface of a radially inward circumferential portion of the arcuate fuel channel, the annular magnet having a central axis; and wherein the maximum radial distance between the magnet and the housing forming the fuel channel is 30% of the thickness of the magnet.

11. The fuel treatment device of claim 10, wherein the fuel channel is formed by at least a portion of the outer cylindrical surface of the magnet.

12. The fuel treatment device of claim 10, wherein the arcuate fuel channel has a "C" shaped radial cross-section with respect to the central axis of the magnet.

13. The fuel treatment device of claim 10, wherein the ratio of the radial cross-sectional area of the fuel channel to the cross-sectional area of the inlet port is 2.5:1 or less.

14. The fuel treatment device of claim 10, wherein 70% or less of the magnet surfaces form at least a portion of the fuel channel.

15. The fuel treatment device of claim 10, wherein the fuel entry port is separated from the fuel exit port by a baffle for directing the fuel into the arcuate fuel channel.

16. The fuel treatment device of claim 10, wherein the ratio of the maximum radial width of the fuel channel to the radial width of the exposed magnet surface is 1.4:1 or less.

17. A method for magnetically treating fuel comprising the steps of:

providing fuel treatment device comprising: a housing, said housing further comprising a housing body, a housing cover, a fuel entry port, a fuel exit port and a generally arcuate fuel channel between the fuel entry port and the fuel exit port; an annular magnet positioned within the housing, the magnet obstructing fuel flow directly between the entry and exit ports, the magnet forming at least a portion of the arcuate fuel channel, the annular magnet having a central axis; and wherein the arcuate fuel channel has a "C" shaped radial cross-section with respect to the central axis of the magnet, the channel having a radially inward circumferential portion and a radially outward circumferential portion, where the cross-section lies in a plane perpendicular to the central axis, and where surfaces of the magnet form the entire radially inward circumferential portion of the "C" shaped arcuate fuel channel;

attaching a fuel line to the fuel entry port and the fuel exit port of the fuel treatment device;

forcing fuel in the fuel treatment device such that the fuel enters the fuel entry port and enters the arcuate fuel channel;

subjecting the fuel to a magnetic field created by the magnet while the fuel is in the fuel channel; and allowing the treated fuel to exit the fuel treatment device through the fuel exit port.

18. The method of claim 17 further comprising the step of keeping the fuel within the fuel channel within a maximum radial distance of not more than 31% of the thickness of the magnet.

19. The method of claim 17, wherein the step subjecting the fuel to a magnetic field created by the magnet while the fuel is in the fuel channel is accomplished by having the fuel in direct contact with 70 percent or less of the magnet surfaces.

20. The method of claim 17, wherein in the step of forcing fuel in the fuel treatment device such that the fuel enters the fuel entry port and enters the arcuate fuel channel, the arcuate channel includes an increased cross-sectional area fluid path, as defined by a ratio of the radial cross-sectional area of the fluid channel to the cross-sectional area of the fuel entry port, to not more than 2.5:1.

* * * * *